United States Patent [19]

Lampietti

[11] Patent Number: 4,520,644

[45] Date of Patent: Jun. 4, 1985

[54] SPRING COILING MACHINE WITH IMPROVED CUT-OFF MEANS

[75] Inventor: Bernard P. Lampietti, Goshen, Conn.

[73] Assignee: Torin Corporation, Torrington, Conn.

[21] Appl. No.: 659,498

[22] Filed: Oct. 10, 1984

Related U.S. Application Data

[63] Continuation of Ser. No. 570,427, Jan. 13, 1984, abandoned, which is a continuation of Ser. No. 510,992, Jul. 5, 1983, abandoned, which is a continuation of Ser. No. 224,919, Jan. 14, 1981, abandoned.

[51] Int. Cl.[3] ..... B21F 11/00

[52] U.S. Cl. ..... 72/131; 72/132

[58] Field of Search ..... 72/127, 129, 130, 131, 72/132, 135, 137, 138, 142, 145

[56] References Cited

U.S. PATENT DOCUMENTS

| | | | |
|---|---|---|---|
| 2,119,002 | 5/1938 | Bergevin et al. | 72/132 |
| 2,820,505 | 1/1958 | Franks et al. | 72/135 X |
| 2,861,622 | 11/1958 | Bonde et al. | 72/131 |
| 3,342,052 | 9/1967 | Boy | 72/138 |
| 3,906,766 | 9/1975 | Sato | 72/132 X |
| 4,112,721 | 9/1978 | Takase et al. | 72/132 X |
| 4,173,135 | 11/1979 | Lamperti | 72/131 X |

*Primary Examiner*—E. Michael Combs

*Attorney, Agent, or Firm*—McCormick, Paulding & Huber

[57] ABSTRACT

A cyclically operable spring coiling machine includes a pair of feed rolls for intermittently advancing wire longitudinally to a coiling station at an upper portion of a vertical front frame of the machine. A coiling arbor and a coiling tool at the station cooperatively form leading end portions of the wire to a coil spring configuration and an improved cut-off means severs the coiled leading end portions of wire to provide individual coil springs. The improved cut-off means includes a pair of tool holders on opposite sides of the coiling arbor movable toward and away from the arbor and wire coiled thereabout and generally in opposition to each other. The holders are employed selectively depending on the hand of the spring being coiled and are respectively mounted on pivot shafts extending rearwardly through the front frame of the machine and geared together at rear end portions. A continuously rotating horizontal shaft forming a part of the coiling machine drive mechanism has a front end portion projecting through the vertical front frame of the machine. An eccentric on the front end portion of the shaft drives an oscillable arm which in turn has a pivotal connection with a lowermost tool holder through an adjustment means. The adjustment means comprises complementary threaded members operable to adjust the movement of the tool holders and thus to vary throw of a cut-off tool thereon toward and away from the coiling arbor.

2 Claims, 4 Drawing Figures

SPRING COILING MACHINE WITH IMPROVED CUT-OFF MEANS

This is a continuation of application Ser. No. 570,427 filed Jan. 13, 1984; abandoned which is a continuation of Ser. No. 510,992 filed July 5, 1983 abandoned which is a continuation of Ser. No. 224,919 filed on Jan. 14, 1981, abandoned.

BACKGROUND OF THE INVENTION

Cut-off operations, the severing of a coil spring formed at a leading end portion of wire, have been accomplished in prior art spring coiling machines by cut-off tools cooperating with an arbor about which the springs are coiled. That is, at the end of a coiling operation, a cut-off tool mounted on a pivotal tool holder is swung into engagement with the wire at the desired position and usually with an anvil-like edge of the coiling arbor immediately therebehind. Holders for the cut-off tools are conventionally mounted on opposite sides of the coiling arbor for selective mounting of cut-off tools thereon for left and right hand springs. The tool holders have been conventionally operated from a cam behind the front frame of the machine and with a relatively complex driving mechanism including push rods etc. operating between the cam and the tool holder. Such tools and operating mechanism have been generally satisfactory but certain difficulties have been encountered particularly in high speed operation of spring coiling machines. The drive mechanisms have tended to be noisy, sometimes inaccurate in operation and with the substantial cut-off forces required, actual bouncing of the cam follower on the cam has been encountered.

It is the general object of the present invention to provide a spring coiling machine having an improved cut-off means which exhibits a high degree of accuracy and dependability in use particularly in high speed operation and which has a high degree of structural strength and integrity as required to efficiently absorb reactive forces during cut-off operations, readily accessible adjustment means also being provided in exposed position negating the requirement for internal adjustment behind the front frame of the coiling machine.

SUMMARY OF THE INVENTION

In fulfillment of the foregoing object, a cyclically operable spring coiling machine having a vertical front frame and a coiling station at an upper portion thereon is provided with at least one pair of oppositely rotatable feed rolls for intermittently advancing wire longitudinally to the coiling station. A relatively fixed coiling arbor at the coiling station is off-set slightly with respect to the line of wire feed movement so that the wire is advanced along one side of the arbor. Preferably, the arbor has generally oppositely oriented anvil-like edges for copperation with a cut-off tool in a cut-off operation. At least one coiling tool is provided at the coiling station and is arranged to engage the longitudinally advancing wire to obstruct the linear movement thereof and thereby to progressively bend the wire about the coiling arbor and impart a coiling stress thereto resulting in the formation of coil springs. At least one cut-off tool at the coiling station includes improved operating means and serves intermittently to sever coiled leading end portions of the wire whereby to provide individual coil springs.

A holder for the cut-off tool is movably supported on and exposed at the front of the machine frame for urging the cut-off tool toward and away from anvil means which may be on the coiling arbor. In movement toward the coiling arbor the cut-off tool engages the wire at a selected position and with an anvil-like edge of the arbor therebehind severs the wire as required. Preferably, a second tool holder is provided generally opposite the first tool holder and is adapted to carry a cutting tool for operation similar to that described but for a spring of opposite hand. When a second holder is provided, a connecting means between the tool holders serves to operate the same in unison but generally in opposition to each other. Preferably, first and second pivot shafts are provided respectively for the tool holders with interconnecting gear means at rear end portions thereof. Thus, the tool holders are operated in unison but under ordinary circumstances only one of the tool holders carries a cut-off tool.

An operating means for the tool holders takes the form of a continuously rotating horizontal shaft which forms a part of the coiling machine drive mechanism and which has a front end portion projecting through the vertical front frame of the machine beneath and in spaced relationship with the tool holders. A rugged and accurate motion transmitting and converting means is exposed at the front of the machine and is connected between the projecting front end portion of the continuously rotating shaft and a first tool holder. The motion transmitting and converting means, preferably including an eccentric on the shaft and an oscillable arm operated thereby, serves to effect a single tool holder and cut-off tool movement toward and away from the coiling arbor and wire coil thereabout during each rotation of the shaft.

There is preferably also included an adjustment means which may comprise complementary threaded elements between the oscillable arm and the first tool holder. The said adjustment means serves to adjust the position of the cut-off tool toward and away from the cutting arbor as may be required for various coil springs. Further, the adjustment means is exposed and readily accessible at the front of the machine for ease and convenience in effecting necessary adjustments during set-up operations of the machine.

DESCRIPTION OF PREFERRED EMBODIMENT

Figure 1:
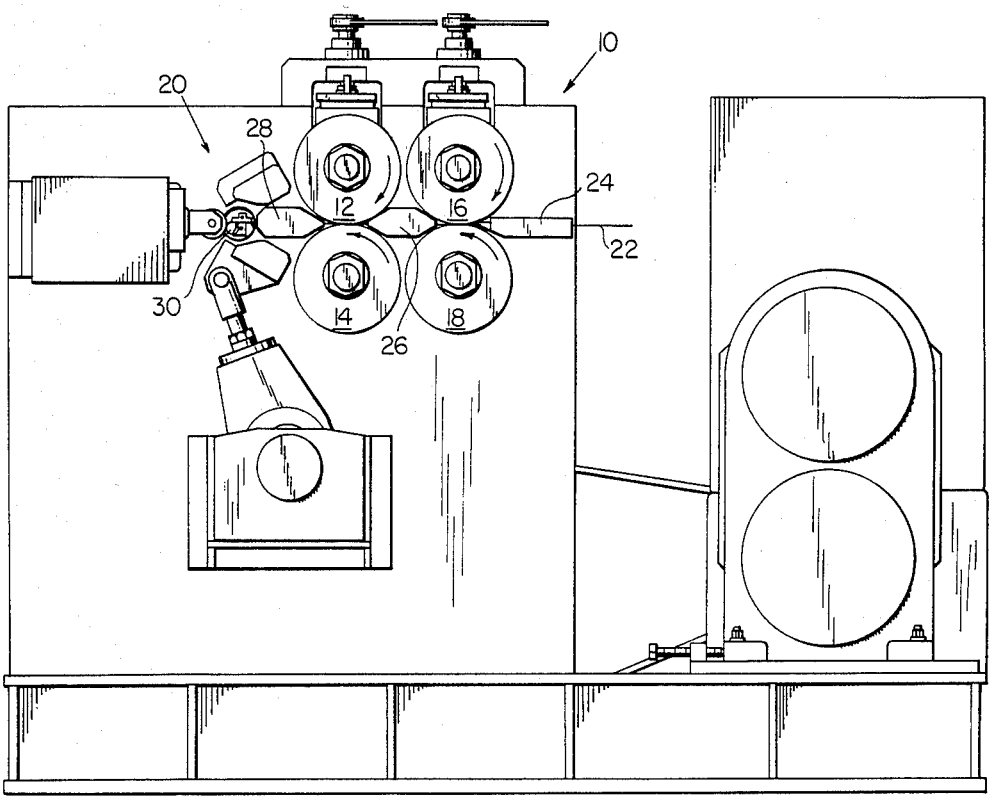
FIG. 1 is a somewhat schematic illustration of a spring coiling machine viewed from the front and including the improved cut-off means of the present invention.

Referring particularly to FIG. 1 it will be observed that a spring coiling machine indicated generally at 10 has first and second pairs of oppositely rotatable feed rolls 12,14 and 16,18 for advancing wire longitudinally leftwardly to a coiling station indicated generally at 20.

Figure 3:
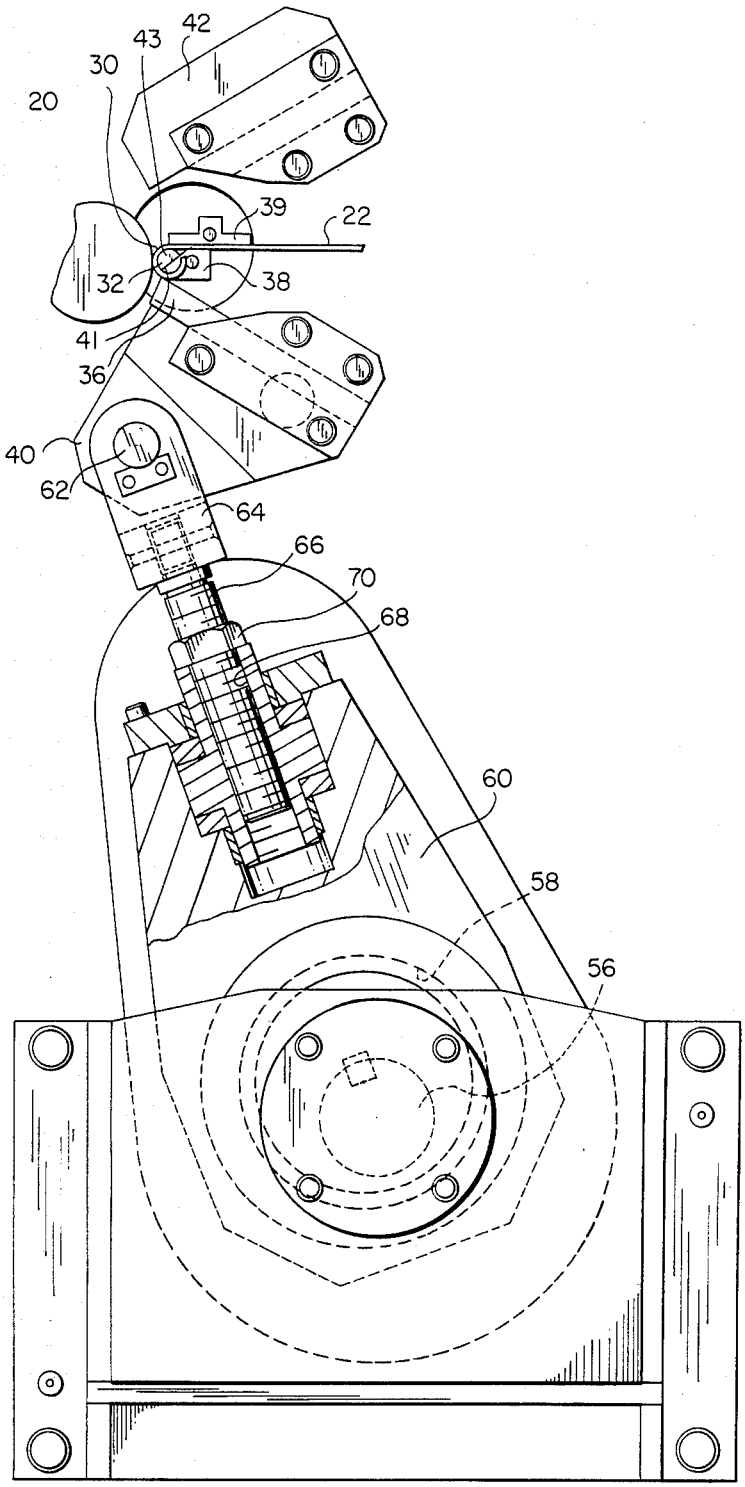
FIG. 3 is a fragmentary enlarged and somewhat schematic view similar to FIG. 1 but better illustrating the improved cut-off means of the present invention.

In FIG. 1, the upper feed rolls 12,16 rotate in a clockwise direction and the lower feed rolls 14,18 rotate in a counterclockwise direction to feed wire 22 leftwardly through guides 24,26 and 28 for the formation of the wire into a coil spring configuration 30 at its leading end portion. As best illustrated in FIG. 3, the leading end portion of the wire 22 is coiled about a coiling arbor 32 at the coiling station 20, the arbor 32 cooperating with a coiling tool 34 in the form of a coiling roll. Coiling arbor 32 and coiling tool 34 are relatively fixed at the coiling station so that longitudinally advancing wire engages the roll 34 and is obstructed in its linear movement thereby, the wire thus being progressively bent about the arbor 32 with a coiling stress imparted thereto resulting in the formation of the leading end coil spring configuration 30.

When the leading end portion of the wire 22 has been coiled through the desired number of convolutions about the arbor 32 it is severed from the remaining portion of the wire 22 by means of a cut-off tool indicated at 36, individual coil springs thus being formed. Element 38 at the coiling station 20 may take the form of a pitch tool engageable with the wire during coiling about the arbor 32 progressively to pitch the same as required for the coil spring to be formed. Element 39 is a final wire guide which cooperates with an upper surface of the pitch tool in guiding the wire 22 immediately prior to coiling of the wire.

The cut-off tool 36 is mounted on a tool holder 40 and cooperates with a separate anvil means or an anvil-like edge 41 formed on the coiling arbor 32. Similarly, a tool holder 42 disposed above the coiling arbor 32 may carry a cut-off tool such as the tool 36 for cooperation with a separate anvil means or a second anvil-like edge 43 on the coiling arbor. The tool holders 40,42 are movable toward and away from the coiling arbor 32 and wire coiled thereabout to effect cut-off operations cooperatively by a tool held thereby and the anvil-like edges 41,43 on the arbor. Thus, springs of opposite hand can be accommodated by selectively employing a cut-off tool on the holders 40,42.

As thus far described and illustrated schematically, the spring coiling machine 10 is or may be conventional and for further illustration and description of such a machine including operating means for elements such as the feed rolls, the pitch tool 38 etc. reference may be had to Bergevin and Nigro U.S. Pat. No. 2,119,002 for Spring Coiling Machine, dated May 3, 1938 and Bergevin U.S. Pat. Re. No. 24,345 for Spring Coiling Machine dated Aug. 20, 1957. The machines shown and described in these patents, however, are of the segment drive type and while highly accurate and dependable in operation they are limited as to the rate of spring production achievable thereon. On the other hand, a high speed spring coiling machine is shown and described in co-pending U.S. application Ser. No. 082,670 filed Oct. 9, 1979 for Spring Coiling Machine With Improved Feed Roll Drive Means, Inventors Erman V. Cavagnero and Nicholas J. Marracino. The improved cut-off means of the present invention finds utility in either type of spring coiling machine but is particularly well suited to the high speed machine of the copending application.

Figure 4:
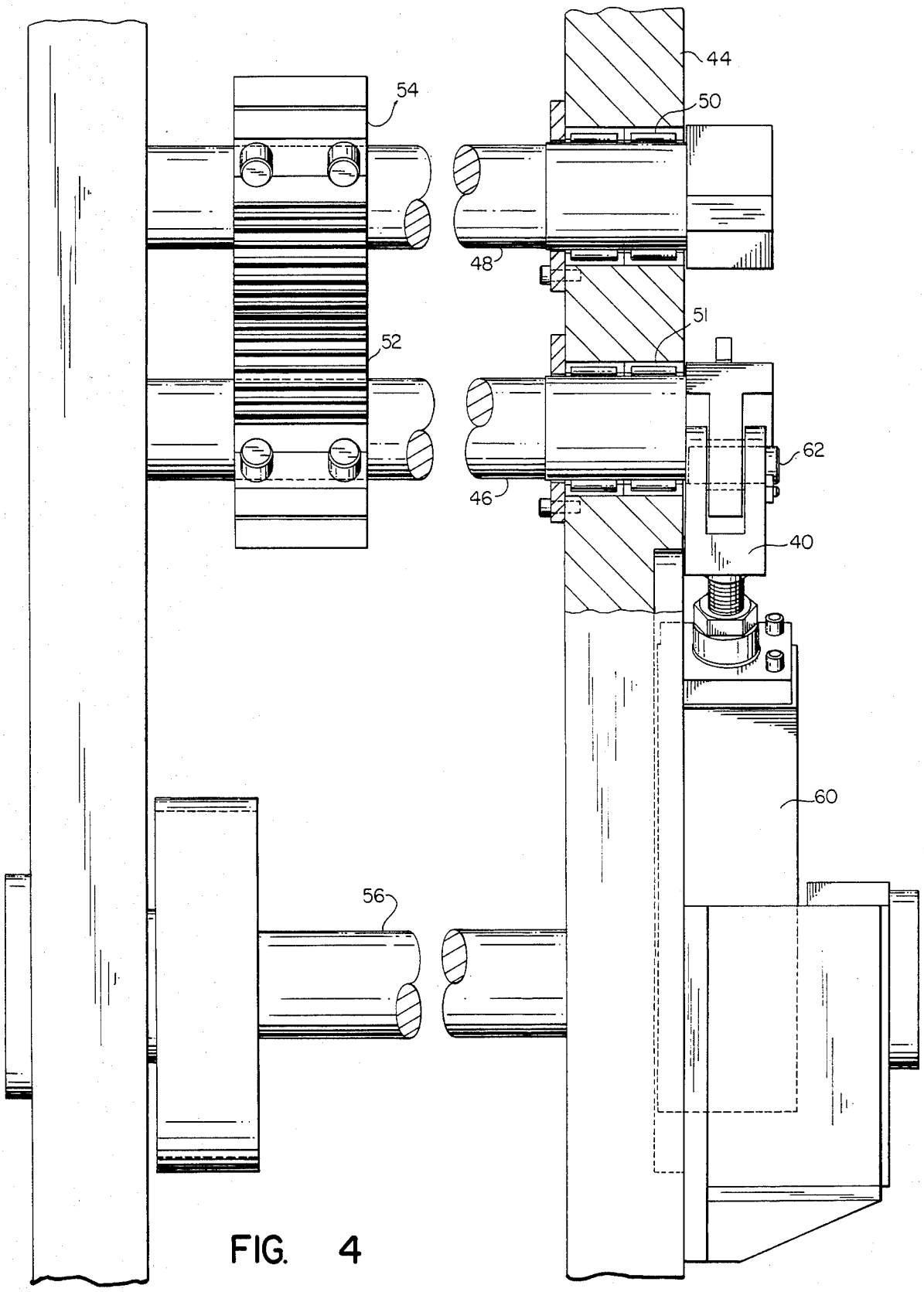
FIG. 4 is a fragmentary enlarged and somewhat schematic vertical section taken generally as indicated at 4,4 in FIG. 3.

Referring particularly to FIGS. 3 and 4, it will be observed that the spring coiling machine 10 has a substantially vertical front frame 44, FIG. 4 and the tool holders 40,42 are mounted forwardly thereof and movable relative thereto. Preferably the tool holders 40,42 are pivotally mounted respectively on pivot shafts 46,48 which project forwardly through the frame 44 of the machine, are journaled respectively at 50,51 and which extend substantially in parallelism rearwardly in the machine. Connecting means between the shafts 46,48 may vary but preferably take the form of drivingly engaged gears 52,54 at rear end portions of the shafts 46,48 respectively. Thus, when one of the tool holders 40,42 is operated pivotally the other tool holder is movable in unison therewith but generally in an opposite direction. In FIG. 3 the lower tool holder 40 of course swings in a clockwise direction in a cut-off operation while the upper tool holder 42 swings in a counterclockwise direction in a cut-off operation. In the presently preferred form of the invention the lower or first tool holder 40 is operated by a drive mechanism to indirectly operate the tool holder 42 through the shafts 46,48 and gears 52,54. Obviously in a set-up operation, a cutting tool 36 may be mounted on the tool holder 40 or, alternatively, the tool 36 may be mounted on the tool holder 42 depending upon the hand of the spring to be severed.

Figure 2:
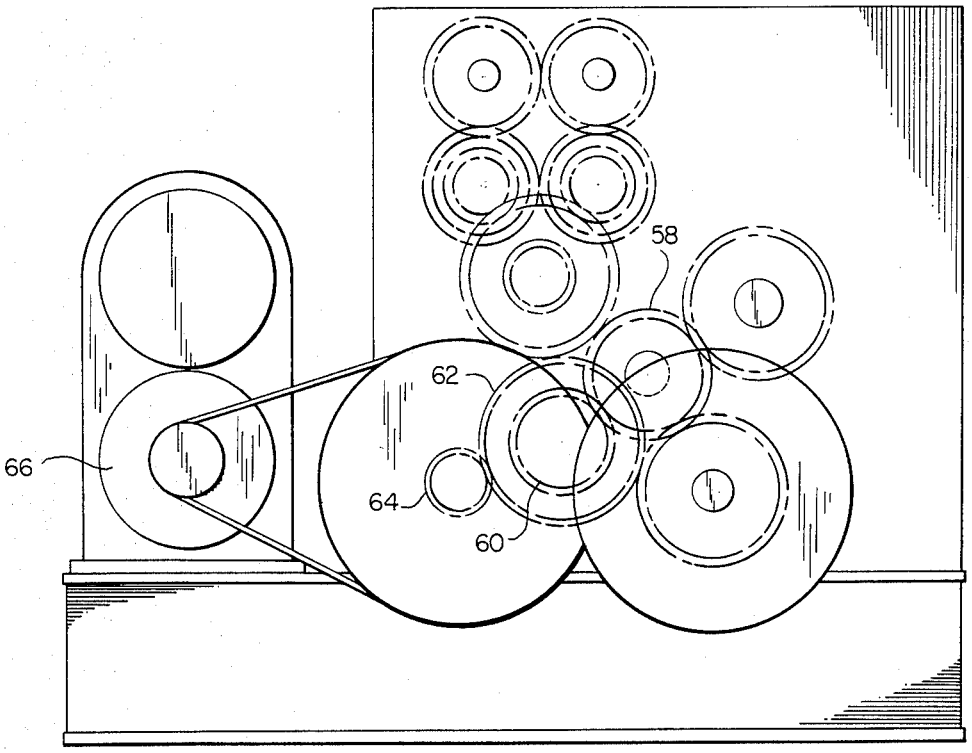
FIG. 2 is a somewhat schematic view taken from the rear of the machine of FIG. 1 and illustrating various drive means in the machine associated with the operating means of FIG. 1.

Further in accordance with the invention, the lower or first tool holder 40 is operated from a horizontally extending and continuously rotating shaft 56 which forms a part of the coiling machine drive mechanism and which has a front end portion thereof projecting forwardly through the vertical front frame 44 of the coiling machine. The shaft 56, as best illustrated in FIGS. 3 and 4 is disposed beneath and in spaced relationship with the tool holder 40 and, as illustrated in FIG. 2, is driven by a gear 58 in turn driven by gear 60 and gears 62 and 64. A belt pulley arrangement drives the gear 64 from a drive motor and speed reducer unit 66 in FIG. 2. As will be apparent, the shaft 56 is one of the main drive or operating shafts of the spring coiling machine and of course may include other operating means such as cams etc. rearwardly of the front frame of the machine.

A motion transmitting and converting means exposed at the front of the machine and connected between the shaft 56 and the tool holder 40 is operable to effect a single tool holder and cut-off tool movement toward and away from the coiling arbor 32 during each rotation of the shaft 56. Thus, the cut-off operation may be readily timed for occurrence once during each cycle of machine operation. In presently preferred form, the motion transmitting and converting means includes an eccentric 58 mounted on the forwardly projecting end portion of the shaft 56 and operatively associated with an oscillable arm 60. The oscillable arm 60 is thus provided with a component of movement toward and away from the tool holder 40 at a pivot pin 62 which connects the motion transmitting and converting means to the tool holder. A bifurcated bracket 64 carries the pivot pin 62 and imparts the desired movement to the tool holder 40 in pivoting the holder about its pivot shaft 46 as required.

Preferably, an adjustment means forms a part of the motion transmitting and converting means and is interposed between the arm 60 and the bracket 64. The adjustment means may vary in form but as shown comprises complementary threaded elements adjustable to vary the throw or degree or amount of movement of the holder 40 about its pivot shaft 46. Thus, springs of various diameter and wire size can be readily accommodated in a set-up operation. The adjustment means is readily accessible from the front of the machine facilitating such set-up operation. As shown, the adjustment means comprises threaded member 66 which enters internally threaded member 68 supported for rotation in an upper end portion of the arm 60. The member 68 may be rotated to effect the necessary adjustment with locknut 70 in a loosened condition and, thereafter the locknut 70 may be tightened to secure the adjustment means in the desired position of adjustment.

From the foregoing it will be apparent that the improved cut-off means of the present invention is of rugged and highly accurate construction. The cut-off means is operated from one of the main shafts of the spring coiling machine by direct connection with an eccentric and oscillable arm having the characteristics of positive and accurate movement. Further, necessary adjustments during set-up operations can be effected with a high degree of ease and convenience. The adjustment means is exposed and readily accessible at the front of the machine eliminating any need to gain entry to and effect adjustments internally of the machine in areas of difficult accessibility.

I claim:

1. In a cyclically operable spring coiling machine having a vertical front frame and a coiling station at an upper portion thereof; the combination of at least one pair of oppositely rotatable feed rolls on said frame for intermittently advancing wire longitudinally to the coiling station, at least one coiling tool at the coiling station arranged to engage the longitudinally advancing wire to obstruct the linear movement thereof whereby progressively to bend the same about the coiling arbor and impart a coiling stress thereto resulting in the formation of a coiling spring configuration at a leading end portion thereof, an anvil means at said coiling station, a pair of cut-off tools at said coiling stations generally on opposite sides of said coiling arbor and co-operable with said anvil means intermittently to sever coiled leading end portions of the wire whereby to provide individual coil springs, a pair of holders for said cut-off tools respectively mounted on pivotally supported shafts and exposed at the front of the machine frame for urging the cut-off tools toward and away from the anvil means and wire coiled thereabout, said pivot shafts projecting rearwardly through the machine frame and carrying interconnecting gears at rear end portions thereof whereby to pivot said tool holders in unison but in generally opposite directions toward and away from the anvil means, a continuously rotating horizontal shaft forming a part of the coiling machine drive mechanism and having one end portion projecting forwardly through the vertical front frame of the machine beneath and in spaced relationship with said tool holders, and motion transmitting and converting means exposed at the front of the machine frame and connected between said projecting end portion of said shaft and one of said tool holders and operable to effect a single tool holder and cut-off tool movement of each tool holder toward and away from said anvil means and wire coiled thereabout during each rotation of said shaft, said motion transmitting and converting means comprising an eccentric mounted on the forwardly projecting end portion of said continuously rotating shaft and an associated arm oscillable thereby to effect the tool holder movement as aforesaid, said oscillable arm being directly connected at one end thereof to said eccentric on said projecting end portion of said continuously rotating horizontal shaft, and further, directly connected at an end of said arm opposite said one end to said one of said tool holders, said arm including an adjustment for changing the throw of said cut-off tools toward and away from the anvil means and wire coiled thereabout.

2. The combination in a cyclically operable spring coiling machine as set forth in claim 1 wherein said anvil means comprises anvil-like edges on said coiling arbor positioned to align generally with cutting edges on said cut-off tools when said cut-off tools are moved toward the coiling arbor in a cut-off operation.

* * * * *